US006092768A

United States Patent [19]

Larson et al.

[11] Patent Number: 6,092,768

[45] Date of Patent: Jul. 25, 2000

[54] RECTANGULAR SUPPORT FRAME FOR SUPPORTING AND TRANSPORTING COMPONENTS OF A CLEANING DEVICE

[75] Inventors: Arden L. Larson, Sioux Falls; John W. Finger; Gary Spilde, both of Beresford, all of S. Dak.

[73] Assignee: Sioux Steam Cleaner Corporation, Beresford, S. Dak.

[21] Appl. No.: 09/106,420

[22] Filed: Jun. 29, 1998

[51] Int. Cl.[7] ..... A47K 1/04

[52] U.S. Cl. ..... 248/129; 248/646; 248/671; 248/676

[58] Field of Search ..... 248/676, 646, 248/637, 671; 280/47.35, 79.3

[56] References Cited

U.S. PATENT DOCUMENTS

| | | | |
|---|---|---|---|
| D. 287,653 | 1/1987 | Nelson . | |
| D. 341,238 | 11/1993 | Sloan, III | D34/18 |
| 3,162,462 | 12/1964 | Elders | 280/47.35 |
| 3,460,566 | 8/1969 | Heartstedt et al. . | |
| 3,490,482 | 1/1970 | Sachs et al. . | |
| 3,669,297 | 6/1972 | Willinger . | |
| 3,687,146 | 8/1972 | Minich, Jr. et al. . | |
| 3,786,835 | 1/1974 | Finger . | |
| 3,814,321 | 6/1974 | Mulholland et al. . | |
| 4,217,924 | 8/1980 | Finger . | |
| 4,321,219 | 3/1982 | Barker . | |
| 4,368,757 | 1/1983 | Finger . | |
| 4,436,113 | 3/1984 | Finger . | |
| 4,552,162 | 11/1985 | Finger . | |
| 4,678,892 | 7/1987 | Finger et al. . | |
| 4,738,541 | 4/1988 | Weber . | |
| 4,998,023 | 3/1991 | Kitts | 280/47.35 |
| 5,259,556 | 11/1993 | Paige et al. . | |
| 5,634,649 | 6/1997 | Breining et al. | 280/47.35 |
| 5,713,584 | 2/1998 | Crane | 280/47.35 |
| 5,738,365 | 4/1998 | McCarthy | 280/651 |

FOREIGN PATENT DOCUMENTS

| | | |
|---|---|---|
| WO 93/04623 | 3/1993 | WIPO . |
| WO 94/24920 | 11/1994 | WIPO . |

*Primary Examiner*—Ramon O. Ramirez
*Assistant Examiner*—Walter Landry

[57] ABSTRACT

A new support frame for supporting a cleaning device. The inventive device includes a base having a pair of spaced apart elongate side bars and spaced apart elongate first and second end bars. The end bars of the base are extended between the side bars of the base. The base has ground engaging members downwardly depending therefrom. The frame also includes first and second end members with each end member having a pair of elongate lower arm portions and an elongate upper cross portion. An upper mounting assembly is spaced apart from the base and is interposed between the base and the upper cross portions of the end members. Elongate first and second upper bars are extended between the arm portions of the first end member and are interposed between the upper cross portion of the first end member and the first end portion of the upper mounting assembly. A handle member is extended from the first end member away from the second end member. A pair of spaced apart elongate mounting brackets are coupled to the upper mounting assembly and to the upper cross portion of the second end member. A bumper member is extended from the second end member away from the first end member. An elongate upper support beam is extended between the upper cross portions of the first and second end members.

20 Claims, 6 Drawing Sheets

RECTANGULAR SUPPORT FRAME FOR SUPPORTING AND TRANSPORTING COMPONENTS OF A CLEANING DEVICE

BACKGROUND OF THE INVENTION

1. Field of the Invention

The present invention relates to support frames, and in particular, support frames for cleaning devices and more particularly pertains to a new support frame for supporting a cleaning device.

2. Description of the Prior Art

The use of support frames, and in particular, support frames for cleaning devices is known in the prior art. More specifically, support frames, and in particular, support frames for cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art support frames, and in particular, support frames for cleaning devices include U.S. Pat. No. 3,789,835; U.S. Pat. No. 4,217,924; U.S. Pat. No. 3,687,156; U.S. Pat. No. 4,552,162; U.S. Pat. No. 5,259,556; U.S. Pat. No. 4,321,219; U.S. Pat. No. 4,436,113; U.S. Pat. No. 4,368,757; U.S. Pat. No. 3,490,482; U.S. Pat. No. 3,814,321; U.S. Pat. No. 4,678,892; U.S. Pat. No. 4,738,541; U.S. Pat. No. 3,669,297; U.S. Pat. No. 3,460,566; PCT Pat. No. WO 93/04623; PCT Pat. No. WO 94/24920; and U.S. Pat. No. Des. 287,653.

The support frame according to the present invention substantially departs from the conventional concepts and designs of the prior art, and in so doing provides an apparatus primarily developed for the purpose of supporting a cleaning device.

SUMMARY OF THE INVENTION

The general purpose of the present invention, which will be described subsequently in greater detail, is to provide a new support frame apparatus and method which has many of the advantages of the support frames, and in particular, support frames for cleaning devices mentioned heretofore and many novel features that result in a new support frame which is not anticipated, rendered obvious, suggested, or even implied by any of the prior art support frames, and in particular, support frames for cleaning devices, either alone or in any combination thereof.

To attain this, the present invention generally comprises a base having a pair of spaced apart elongate side bars and spaced apart elongate first and second end bars. The end bars of the base are extended between the side bars of the base. The base has ground engaging members downwardly depending therefrom. The frame also includes first and second end members with each end member having a pair of elongate lower arm portions and an elongate upper cross portion. An upper mounting assembly is spaced apart from the base and is interposed between the base and the upper cross portions of the end members. Elongate first and second upper bars are extended between the arm portions of the first end member and are interposed between the upper cross portion of the first end member and the first end portion of the upper mounting assembly. A handle member is extended from the first end member away from the second end member. A pair of spaced apart elongate mounting brackets are coupled to the upper mounting assembly and to the upper cross portion of the second end member. A bumper member is extended from the second end member away from the first end member. An elongate upper support beam is extended between the upper cross portions of the first and second end members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support frame apparatus and method which has many of the advantages of the support frames, and in particular, support frames for cleaning devices mentioned heretofore and many novel features that result in a new support frame which is not anticipated, rendered obvious, suggested, or even implied by any of the prior art support frames, and in particular, support frames for cleaning devices, either alone or in any combination thereof.

It is another object of the present invention to provide a new support frame which may be easily and efficiently manufactured and marketed.

It is a further object of the present invention to provide a new support frame which is of a durable and reliable construction.

An even further object of the present invention is to provide a new support frame which is susceptible of a low cost of manufacture with regard to both materials and labor, and which accordingly is then susceptible of low prices of sale to the consuming public, thereby making such support frame economically available to the buying public.

Still yet another object of the present invention is to provide a new support frame which provides in the apparatuses and methods of the prior art some of the advantages thereof, while simultaneously overcoming some of the disadvantages normally associated therewith.

Still another object of the present invention is to provide a new support frame for supporting a cleaning device.

Yet another object of the present invention is to provide a new support frame which includes a base having a pair of spaced apart elongate side bars and spaced apart elongate first and second end bars. The end bars of the base are extended between the side bars of the base. The base has ground engaging members downwardly depending therefrom. The frame also includes first and second end members with each end member having a pair of elongate lower arm portions and an elongate upper cross portion. An upper mounting assembly is spaced apart from the base and is interposed between the base and the upper cross portions of the end members. Elongate first and second upper bars are extended between the arm portions of the first end member and are interposed between the upper cross portion of the first end member and the first end portion of the upper mounting assembly. A handle member is extended from the first end member away from the second end member. A pair of spaced apart elongate mounting brackets are coupled to the upper mounting assembly and to the upper cross portion of the second end member. A bumper member is extended from the second end member away from the first end member. An elongate upper support beam is extended between the upper cross portions of the first and second end members.

Still yet another object of the present invention is to provide a new support frame that is adapted for mounting cleaning devices having an heating elements assembly, an electrical panel assembly, a motor and pump assembly, a reservoir assembly for detergent, and a cleaning gun assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
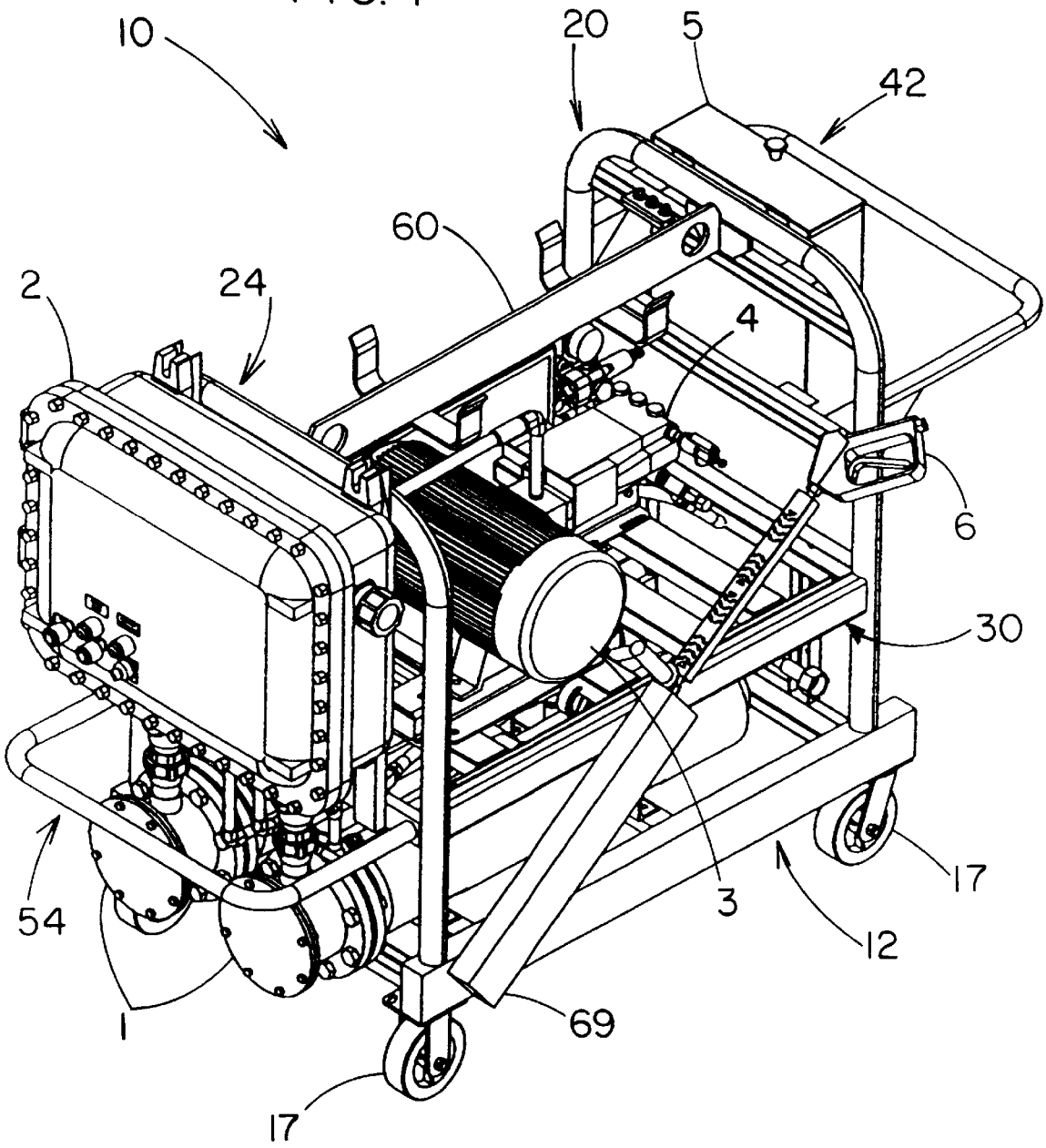
FIG. 1 is a schematic first end perspective view of a new support frame with a cleaning device mounted thereto according to the present invention.
Figure 2:
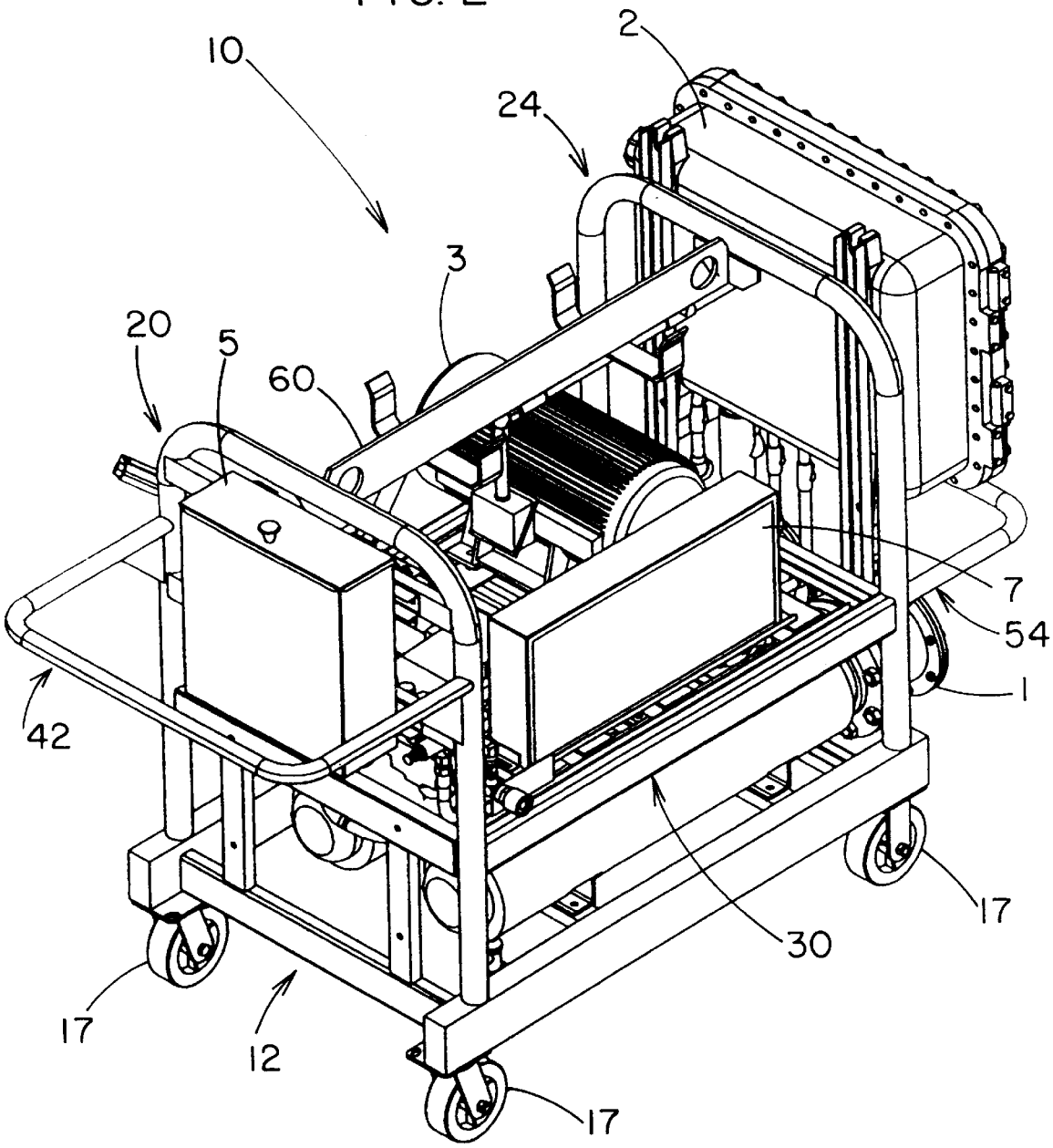
FIG. 2 is a schematic second end perspective view of the present invention with a cleaning device mounted thereto.
Figure 3:
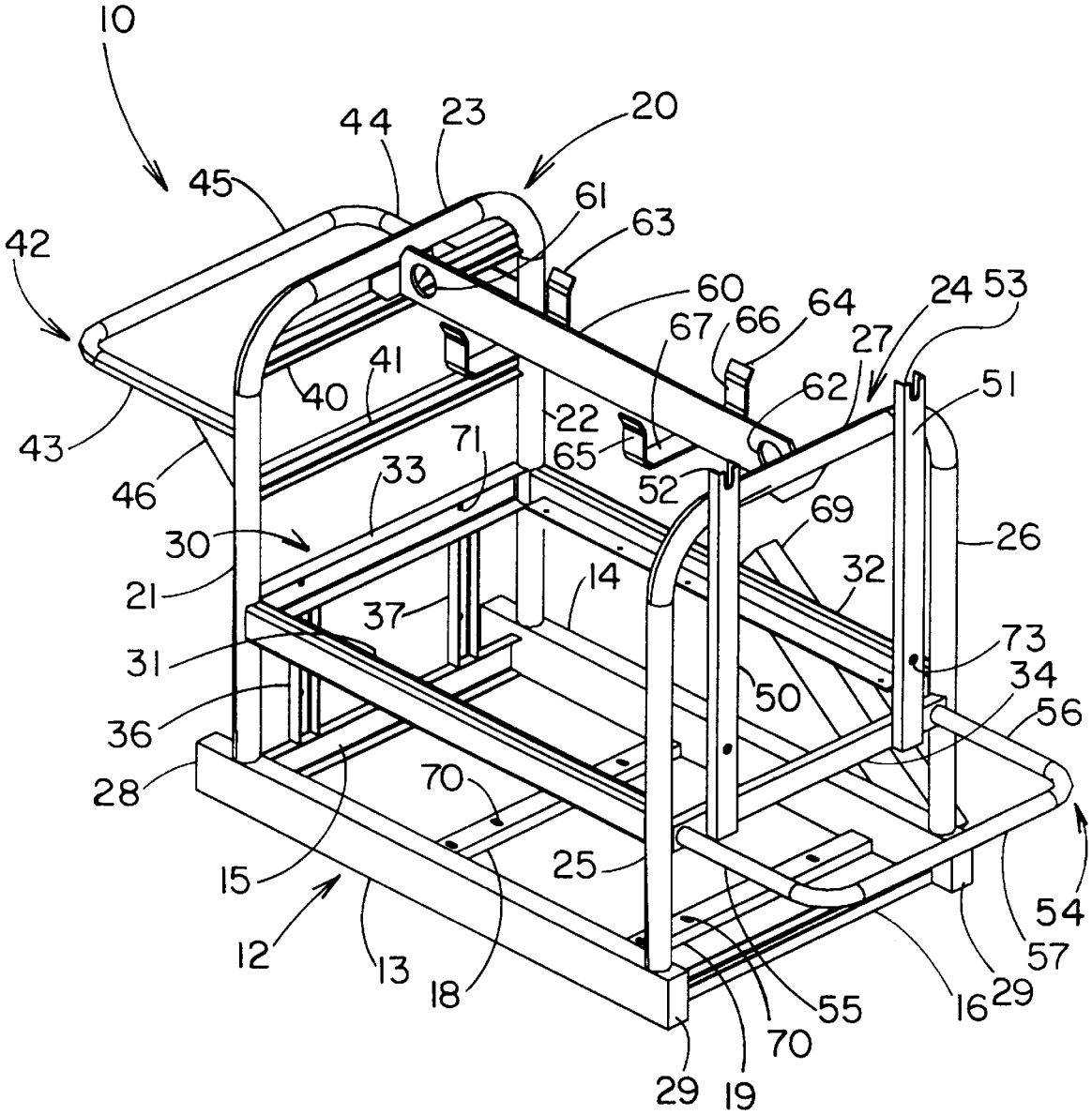
FIG. 3 is a schematic second end perspective view of the present invention.
Figure 4:
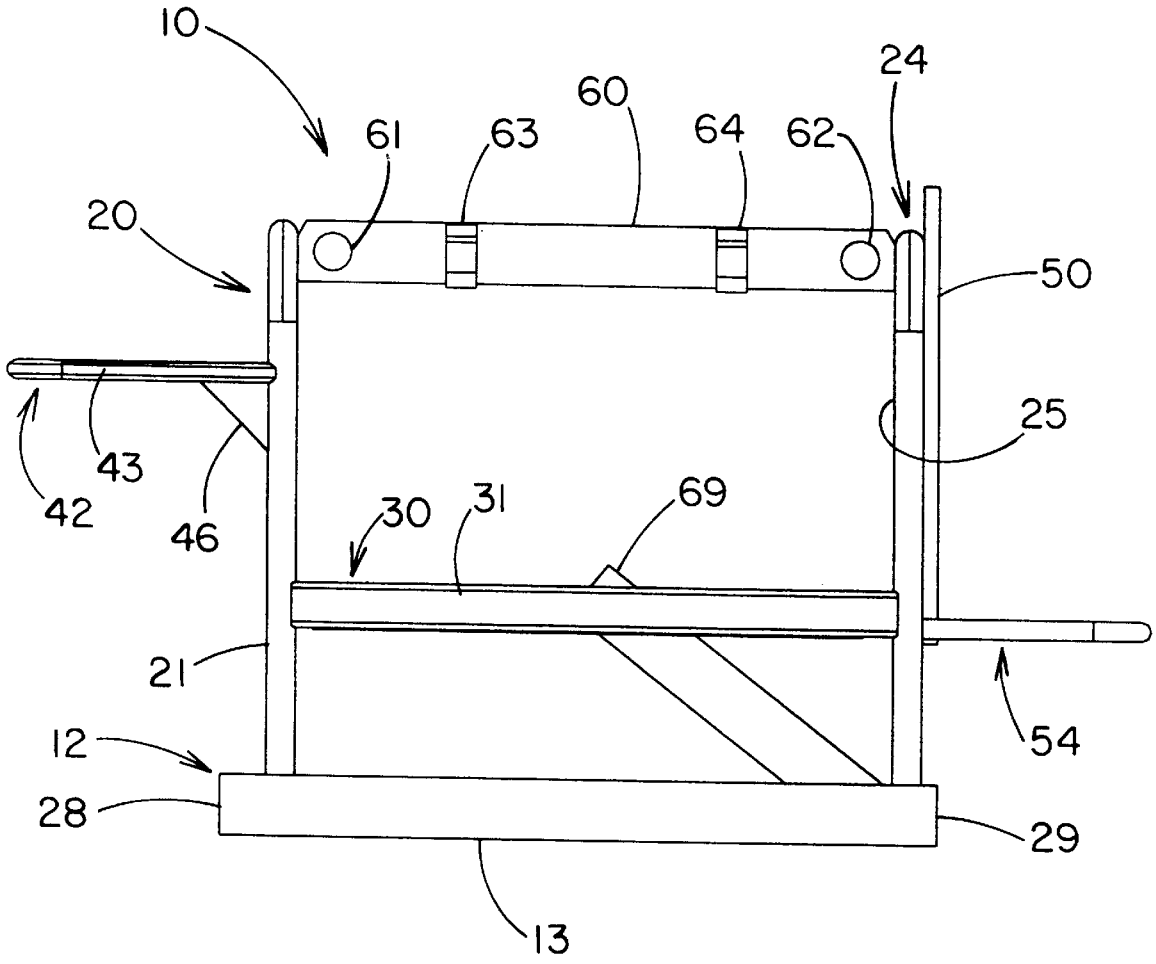
FIG. 4 is a schematic side view of the present invention.
Figure 5:
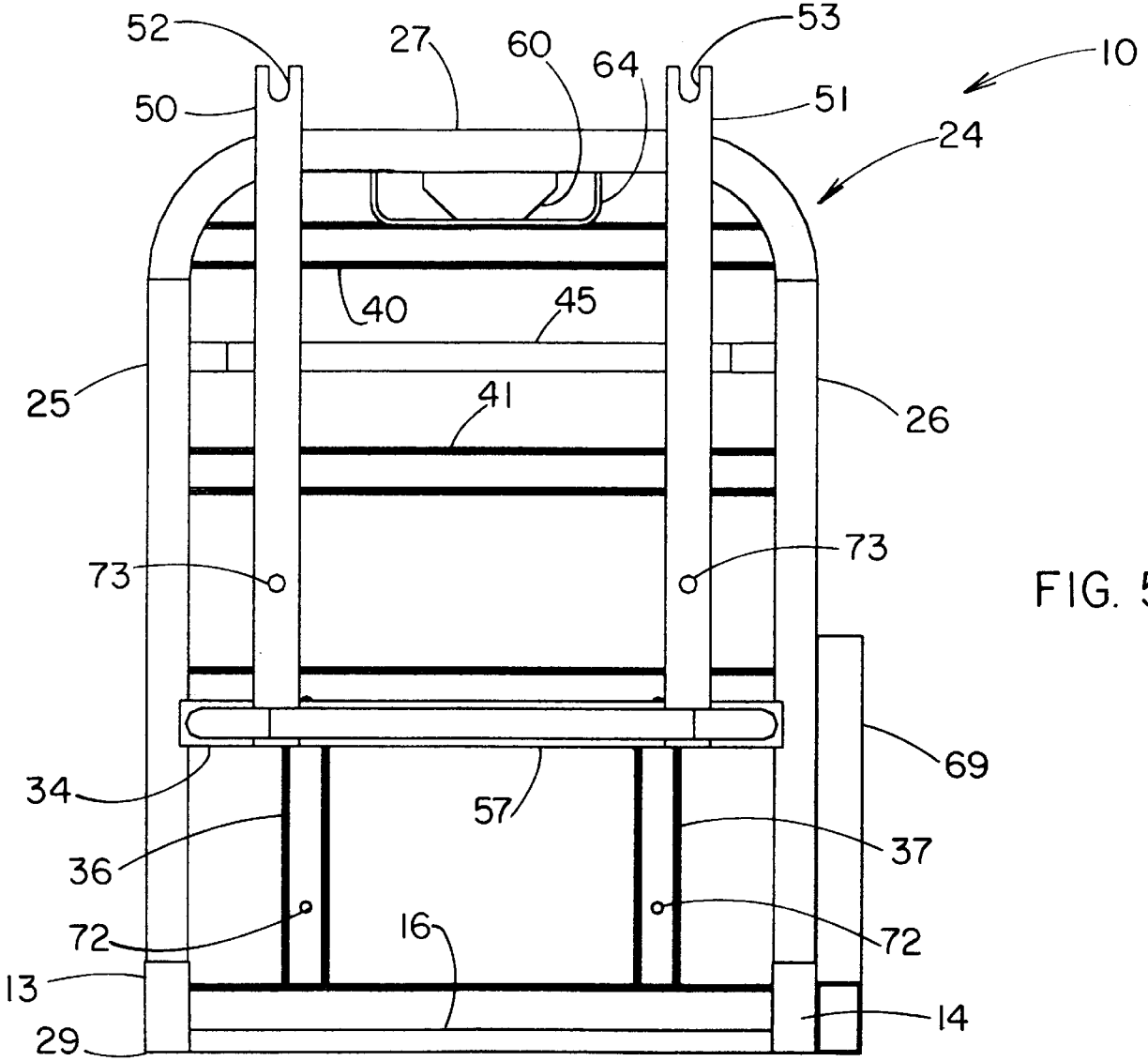
FIG. 5 is a schematic second end side view of the present invention.
Figure 6:
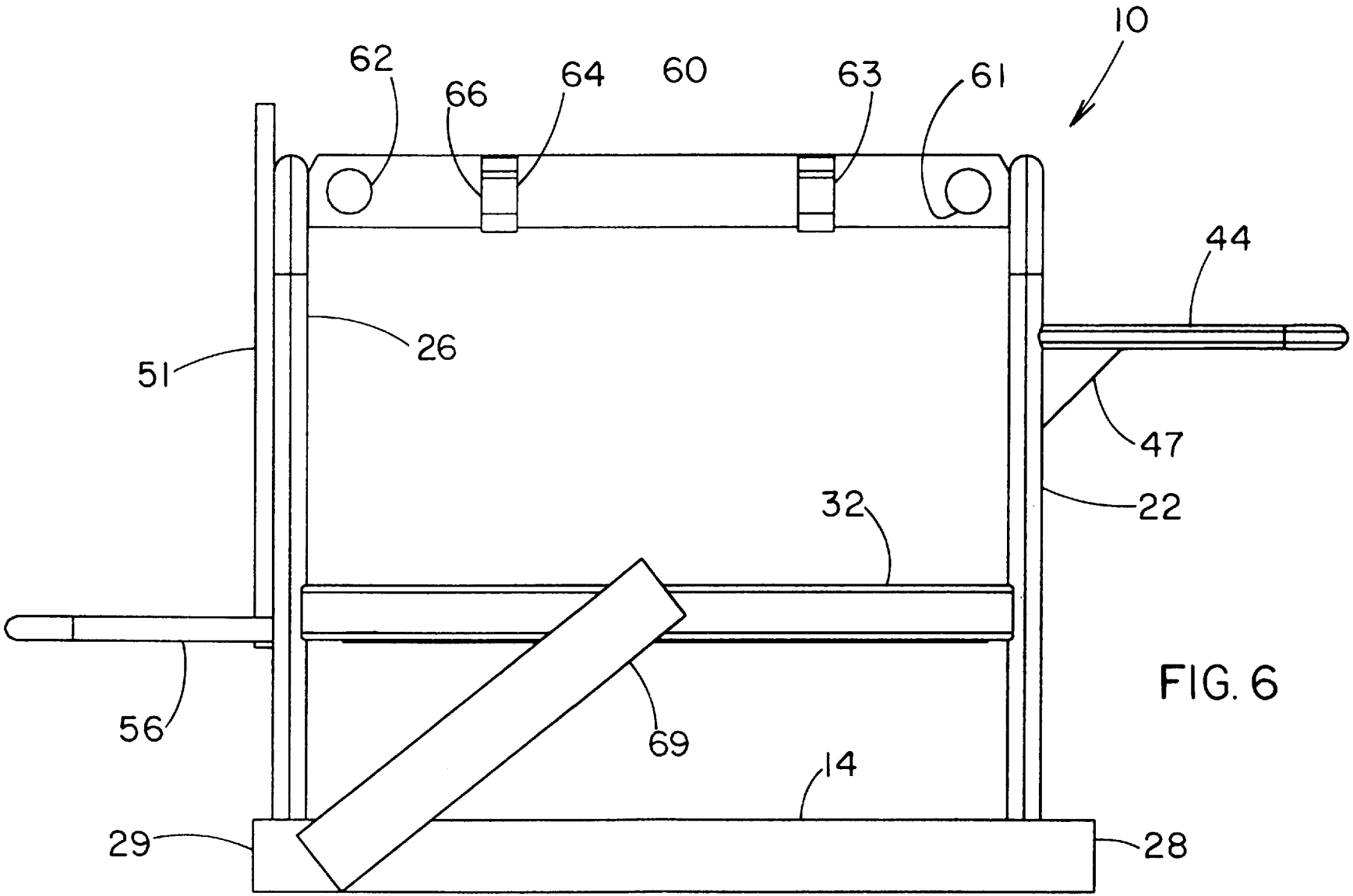
FIG. 6 is a schematic another side view of the present invention.

With reference now to the drawings, and in particular to FIGS. 1 through 6 thereof, a new support frame embodying the principles and concepts of the present invention and generally designated by the reference numeral 10 will be described.

As best illustrated in FIGS. 1 through 6, the support frame 10 generally comprises a base 12 having a pair of spaced apart elongate side bars 13,14 and spaced apart elongate first and second end bars 15,16. The end bars 15,16 of the base 12 are extended between the side bars 13,14 of the base 12. The base 12 has ground engaging members 17 downwardly depending therefrom. The frame 10 also includes first and second end members 20,24 with each end member 20,24 having a pair of elongate lower arm portions 21,22,25,26 and an elongate upper cross portion 23,27. An upper mounting assembly 30 is spaced apart from the base 12 and is interposed between the base 12 and the upper cross portions 23,27 of the end members 20,24. Elongate first and second upper bars 40,41 are extended between the arm portions 21,22 of the first end member 20 and are interposed between the upper cross portion 23 of the first end member 20 and the first end portion 33 of the upper mounting assembly 30. A handle member 42 is extended from the first end member 20 away from the second end member 24. A pair of spaced apart elongate mounting brackets 50,51 are coupled to the upper mounting assembly 30 and to the upper cross portion 27 of the second end member 24. A bumper member 54 is extended from the second end member 24 away from the first end member 20. An elongate upper support beam 60 is extended between the upper cross portions 23,27 of the first and second end members 20,24.

In use, the support frame is preferably designed for mounting thereto a cleaning device having an heating elements assembly 1, an electrical panel assembly 2, a motor and pump assembly 3,4, a reservoir assembly 5 for detergent, and a cleaning gun assembly 6. The support frame 10 allows easy maneuvering of the cleaning device including suspension of the cleaning device from a structure.

In closer detail, the base 12 is generally rectangular and has a pair of spaced apart elongate side bars 13,14 and spaced apart elongate first and second end bars 15,16. Each of the side bars 13,14 of the base 12 has first and second ends 28,29. The end bars 15,16 of the base 12 are extended between the side bars 13,14 of the base 12 with the first end bar 15 preferably positioned adjacent the first ends 28 of the side bars 13,14 and the second end bar 16 preferably positioned adjacent the second ends 29 of the side bars 13,14. Preferably, the lengths the side bars 13,14 of the base 12 are substantially parallel with each other while the lengths of the end bars of the base 12 are substantially parallel with each other and substantially perpendicular to the lengths the side bars 13,14 of the base 12. Ideally, the side bars 13,14 and the end bars of the base 12 each have a generally rectangular cross section taken perpendicular to their respective lengths.

The base 12 also has ground engaging members downwardly depending therefrom. Preferably, the ground engaging members comprise a plurality of wheels 17 with each of the ends 28,29 of the side bars 13,14 of the base 12 having a wheel 17 coupled thereto. In the preferred embodiment, one of the wheels 17 of each the side bars 13,14 is positioned adjacent the first end 28 of the side bar while the other wheel 17 is positioned adjacent the second end 29 of the side bar. The base 12 has also includes a pair of spaced apart elongate lower cross bars 18,19 in the preferred embodiment. The lower cross bars 18,19 extend between the side bars 13,14 of the base 12 and interposed between the first and second end bars 5,16 of the base 12. Ideally, each of the lower cross bars 18,19 of the base 12 also has a plurality of mounting holes 70. The lower cross bars 18,19 of the base 12 are designed for mounting an heating elements assembly I of a cleaning device thereto.

The frame 10 also includes first and second end members 20,24 which are upwardly extended from the base 12. Each the end member is a generally inverted U-shape and has a pair of elongate lower arm portions 21,22,25,26 and an elongate upper cross portion 23,27 connecting their respective arm portions together. The first end member 20 is positioned adjacent the first ends 28 of the side bars 13,14 of the base 12. One of the arm portions 21 of the first end member 20 is coupled to the first end of one of the side bars 13 of the base 12 while the other arm portion 22 is coupled to the first end of the other side bar 14 of the base 12. The second end member is positioned adjacent the second ends 29 of the side bars 13,14 of the base 12 with its arm portions 25,26 coupled to the second ends 29 of the side bars 13,14 in a similar fashion as the arm portions 21,22 of the first end member 20. Preferably, the end members 20,24 each have a generally circular cross section. In the ideal embodiment of the invention, each of the end members 20,24 lie in planes substantially perpendicular to the plane the base 12 lies in.

An upper mounting assembly 30 is spaced apart from the base 12 and is interposed between the base 12 and the upper cross portions 23,27 of the end members 20,24 so that the upper mounting assembly 30 extends between the end members 20,24. The upper mounting assembly 30 is designed for mounting a motor and pump assembly 3,4 including a belt guard housing 7. Preferably, the upper mounting assembly 30 lies in a plane substantially parallel to the plane the base 12 lies in. In the preferred embodiment, the upper mounting assembly 30 comprises a pair of spaced apart elongate side portions 31,32 and spaced apart first and second end portions 33,34. Preferably, the lengths the side portions 31,32 of the upper mounting assembly 30 are substantially parallel with each other, while the side portions 31,32 of the upper mounting assembly 30 are substantially parallel with the side bars 13,14 of the base 12. In this preferred embodiment, it is even more preferable that the lengths of the end portions 33,34 of the upper mounting assembly 30 are substantially parallel with each other and substantially perpendicular to the lengths the side portions 31,32 of the upper mounting assembly 30.

The side portions 31,32 of the upper mounting assembly 30 are extended between the first and second end members 20,24, with one of the side portions 31 of the upper mounting assembly 30 extending between one pair of associated arm portions 21,25 and the other side portions 32 extending between the other pair of associated arm portions 22,26 of the first and second end members 20,24. The first end portion 33 of the upper mounting assembly 30 is extended between the arm portions 21,22 of the first end member 20, while the second end portion 34 of the upper mounting assembly 30 is extended between the arm portions 25,26 of the second end member. Ideally, the first end portion 33 of the upper mounting assembly 30 has a plurality of spaced apart holes 71.

Preferably, a pair of spaced apart elongate braces 36,37 are extended between the first end bar 15 of the base 12 and the first end portion 33 of the upper mounting assembly 30. Preferably, each of the braces 36,37 has a hole 72 therethrough. The lengths of the braces 36,37 are substantially parallel with each other and substantially perpendicular to the first end portion 33 of the upper mounting assembly 30 and the first end bar 15 of the base 12.

Elongate first and second upper bars 40,41 are extended between the arm portions 21,22 of the first end member 20. The first and second upper bars 40,41 are spaced apart from each other and are interposed between the upper cross portion 23 of the first end member 20 and the first end portion 33 of the upper mounting assembly 30 so that the lengths of the upper bars 40,41 are substantially parallel with each other and substantially parallel to the first end portion 33. The upper bars 40,41 are designed for mounting thereto a reservoir assembly 5 for holding a fluid detergent.

The handle member 42 is designed for permitting maneuvering of the support frame and for helping protect the reservoir 5 from damage. The handle member 42 is generally U-shaped and has a pair of spaced apart elongate arms 43,44 and a main portion 45 connecting the arms of the handle member 42 together. The handle member 42 is extended from the first end member 20 away from the second end member. The handle member 42 is also positioned between the upper bars 40,41 coupled to the first end member 20. Preferably, one of the arms 43 of the handle member 42 is coupled to one of the arm portions 21 of the first end member 20 while the other arm 44 of the handle member 42 is coupled to the other arm portion 22 of the first end member 20. Preferably, the handle member 42 lies in a plane substantially perpendicular to the plane the first end member 20 lies in. Ideally, a pair of generally triangular handle braces 46,47, support the handle member 42 with one handle brace 46 coupled to one of the arm 43 and its associated arm portion 21 and the other handle brace 47 coupled to the other arm 44 of the handle member 42 and its associated arm portion 22 of the first end member 20. The handle braces 46,47 are designed for providing additional structural support to the handle member 42.

The support frame 10 also has a pair of spaced apart elongate mounting brackets 50,51. The upper ends of each of the mounting brackets 50,51 has a slot 52,53 which designed for holding items such as an electrical cord therein. Each of the mounting brackets 50,51 is coupled to the second end portion 34 of upper mounting assembly 30 and to the upper cross portion 27 of the second end member. The upper ends of the mounting brackets 50,51 are upwardly extended from the upper cross portion 27 of the second end member 24 such that the slots 52,53 of the mounting brackets 50,51 extend upwards from the upper cross portion of the second end member. Preferably, each of the mounting brackets has a hole 73.

The bumper member 54 is generally U-shaped and has a pair of spaced apart elongate arms 55,56 and a main portion 57 connecting the arms of the bumper member 54 together. The bumper member 54 is extended from the second end member 24 away from the first end member 20. The arms 55,56 of the bumper member 54 are coupled to the second end portion 34 of the upper mounting assembly 30 such that one of the arms 55 of the bumper member 54 is positioned adjacent one of the arm portions 25 of the second end member 24 and the other arm 56 of the bumper member 54 is positioned adjacent the other arm portion 26 of the second end member 24. The bumper member 54 is designed for helping protect the heating elements assembly 1 and the electrical panel assembly 2 from damage.

The elongate upper support beam 60 extends between the upper cross portions 23,27 of the first and second end members 20,24 so that the length of the upper support beam 60 is generally parallel to the lengths of the side portions 31,32 of the upper mounting assembly 30. The upper support beam 60 preferably has a pair of generally circular apertures 61,62 which are designed for inserting items such as hooks and chains therethrough for lifting and suspending the support frame 10. One of the apertures 61 is located adjacent the first end member 20 while the other aperture 62 is located adjacent the second end member 24. Preferably, a pair of spaced apart holding members 63,64 are coupled to the support beam 60. The holding members 63,64 are designed for holding items such as flexible hose and electrical cord to the support frame. Each holding member is generally U-shaped and has a pair of spaced apart fingers 65,66 and a connecting portion 67 connecting the fingers 65,66 together. The connecting portions 67 of the holding members 63,64 are coupled to the upper support beam 60 such that the upper support beam 60 is positioned between the fingers of each holding portion. Preferably, each of the fingers 65,66 has a flared terminal end outwardly extending away from the upper support beam 60.

Preferably, an elongate sheath member 69 with an open end is coupled to one of the side bars 14 of the base 12 and to the adjacent side portion 32 of the upper mounting assembly 30. The open end of the sheath member 69 is positioned adjacent the upper mounting assembly 30. The sheath is designed for insertion of a portion of a cleaning gun assembly 6 into the open end of the sheath member 69.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A support frame for a cleaning device having a heating elements assembly, an electrical panel assembly, a motor and pump assembly, a reservoir assembly for detergent, and a cleaning gun assembly, said support frame comprising:

a base having a pair of spaced apart elongate side bars and spaced apart elongate first and second end bars, each of said side bars of said base having first and second ends, said end bars of said base being extended between said side bars of said base, said first end bar being positioned adjacent said first ends of said side bars of said base, said second end bar being positioned adjacent said second ends of said side bars of said base;

said base having ground engaging members downwardly depending therefrom;

first and second end members, each said end member having a pair of elongate lower arm portions and an elongate upper cross portion;

said first end member being positioned adjacent said first ends of said side bars of said base;

said second end member being positioned adjacent said second ends of said side bars of said base;

an upper mounting assembly for supporting the motor and pump assembly, said upper mounting assembly being adapted to be spaced apart from said base and being interposed between said base and said upper cross portions of said end members;

elongate first and second upper bars for supporting the reservoir assembly, said first and second upper bars extending between said arm portions of said first end member, said first and second bars being spaced apart from each other and being interposed between said upper cross portion of said first end member and said first end portion of said upper mounting assembly;

a handle member having a pair of spaced apart elongate arms and a main portion, said handle member being adapted to be extended from said first end member away from said second end member;

a pair of spaced apart elongated mounting brackets for supporting the electrical panel assembly, each of said mounting brackets having upper and lower ends, each of said mounting brackets being coupled to said upper mounting assembly and to said upper cross portion of said second end member, said upper ends of said of said mounting brackets being upwardly extended from said upper cross portion of said second end member;

a bumper member having a pair of spaced apart elongate arms and a main portion, said bumper member extending from said second end member away from said first end member; and an elongate upper support beam mounted to and extending between each of said upper cross portions of said first and second end members for supporting said first and second end members when the reservoir assembly is mounted on said first end member and the electrical panel assembly is mounted on said second end member.

2. The support frame of claim 1, wherein said first and second end members each extend substantially the same distance from said base, and said upper support beam extends substantially parallel to said base.

3. The support frame of claim 1, wherein said ground engaging members comprise a plurality of wheels, and wherein each of said side bars of said base has a pair of wheels coupled thereto, one of said wheels of each said side bar being positioned adjacent said first end of said side bar and another of said wheel of each said side bar being positioned adjacent said second end of said side bar.

4. The support frame of claim 1, wherein said base has a pair of elongate lower cross bars for supporting heating elements of the heating elements assembly, said cross bars extending between said side bars of said base, said lower cross bars of said base being spaced apart from one another and being interposed between said first and second end bars of said base.

5. The support frame of claim 1, wherein each of said end members lie in planes substantially perpendicular to the plane said base lies in, wherein said upper mounting assembly lies in a plane substantially parallel to the plane said base lies in, and wherein said handle member lies in a plane substantially perpendicular to the plane said first end member lies in.

6. The support frame of claim 1, wherein one of said arm portions of said first end member is coupled to one of said side bars of said base, wherein another of said arm portions of said first end member is coupled to another of said side bars of said base, wherein one of said arm portions of said second end member is coupled to one of said side bars of said base, and wherein another of said arm portions of said second end member is coupled to another of said side bars of said base.

7. The support frame of claim 1, wherein said upper mounting assembly comprises a pair of spaced apart elongate side portions and spaced apart first and second end portions;

said side portions of said upper mounting assembly being extended between said first and second end members, one of said side portions of said upper mounting assembly being extended between one pair of associated arm portions of said first and second end members, another of said side portions of said upper mounting assembly being extended between another pair of associated arm portions of said first and second end members; and said first end portion of said upper mounting assembly being extended between said arm portions of said first end member, said second end portion of said upper mounting assembly being extended between said arm portions of said second end member.

8. The support frame of claim 7, further comprising a pair of spaced apart elongate braces being extended between said first end bar of said base and said first end portion of said upper mounting assembly.

9. The support frame of claim 1, wherein said handle member is positioned between said upper bars.

10. The support frame of claim 1, wherein said handle member is mounted to said first end member at a first distance from said base, and said bumper member is mounted to said second end member at a second distance from said base, and wherein said first distance is approximately twice said second distance; and wherein said handle member extends a distance from said first end member substantially equal to a distance that said bumper member extends from said second end member.

11. The support frame of claim 10, further comprising a pair of handle braces, one of said handle braces being coupled to one of said arm of said handle member and its associated arm portion of said first end member, another of said handle braces being coupled to another of said arms of said handle member and its associated arm portion of said first end member.

12. The support frame of claim 11, wherein said handle braces are generally triangular in shape.

13. The support frame of claim 1, wherein said upper end of each of said mounting brackets has a slot, said upper ends of said of said mounting brackets being upwardly extended from said upper cross portion of said second end member such that said slots of said mounting brackets extend upwards from said upper cross portion of said second end member.

14. The support frame of claim 1, wherein said arms of said bumper member are coupled to said second end portion of said upper mounting assembly such that one of said arms of said bumper member is positioned adjacent one of said arm portions of said second end member and another of said arms of said bumper member is positioned adjacent another of said arm portions of said second end member.

15. The support frame of claim 1, wherein said upper support beam has a pair of apertures adapted for receiving a hook for lifting said support frame, one of said apertures being located adjacent said first end member, another of said apertures being located adjacent said second end member.

16. The support frame of claim 1, further comprising a pair of spaced apart holding members for supporting a length of flexible hose on said support frame, each holding member having a pair of spaced apart fingers and a connecting portion, said connecting portions of said holding member being coupled to said upper support beam such that said upper support beam is positioned between said fingers of each holding portion.

17. The support frame of claim 1, further comprising an elongate sheath member for supporting the portion of a cleaning gun assembly, said sheath member having an open end for receiving said sheath member being coupled to one of said side bars of said base at a location adjacent to said second end member and to said upper mounting assembly at a substantially central location between said first and second end members such that the sheath member is positioned at an acute angle with respect to said base, said open end of said sheath member being positioned adjacent said upper mounting assembly.

18. A support frame for a cleaning device having a heating elements assembly, an electrical panel assembly, a motor and pump assembly, a reservoir assembly for detergent, and a cleaning gun assembly, said support frame comprising:

a base being generally rectangular and having a pair of spaced apart elongate side bars and spaced apart elongate first and second end bars, each of said side bars of said base having first and second ends, said end bars of said base extending between said side bars of said base, said first end bar being positioned adjacent said first ends of said side bars of said base, said second end bar being positioned adjacent said second ends of said side bars of said base;

said base having ground engaging members downwardly depending therefrom, wherein said ground engaging members comprise a plurality of wheels, wherein each of said side bars of said base has a pair of wheels coupled thereto, one of said wheels of each said side bar being positioned adjacent said first end of said side bar and another of said wheel of each said side bar being positioned adjacent said second end of said side bar;

said base having a pair of elongate lower cross bars for supporting heating elements of the heating elements assembly, said cross bars extending between said side bars of said base, said lower cross bars of said base being spaced apart from one another and being interposed between said first and second end bars of said base, each of said lower cross bars of said base having a plurality of mounting holes;

first and second end members, each said end member having a pair of elongate lower arm portions and an elongate upper cross portion;

wherein each of said end members lie in planes substantially perpendicular to the plane said base lies in;

wherein said first and second end members each extend substantially the same distance from said base;

said first end member being positioned adjacent said first ends of said side bars of said base, one of said arm portions of said first end member being coupled to one of said side bars of said base, another of said arm portions of said first end member being coupled to another of said side bars of said base;

said second end member being positioned adjacent said second ends of said side bars of said base, one of said arm portions of said second end member being coupled to one of said side bars of said base, another of said arm portions of said second end member being coupled to another of said side bars of said base, an upper mounting assembly for supporting the motor and pump assembly, said upper mounting assembly being adapted to be spaced apart from said base and being interposed between said base and said upper cross portions of said end members;

wherein said upper mounting assembly lies in a plane substantially parallel to the plane said base lies in;

said upper mounting assembly comprising a pair of spaced apart elongate side portions and spaced apart first and second end portions;

said side portions of said upper mounting assembly extending between said first and second end members, one of said side portions of said upper mounting assembly being adapted to be extended between one pair of associated arm portions of said first and second end members, another of said side portions of said upper mounting assembly being adapted to be extended between another pair of associated arm portions of said first and second end members;

said first end portion of said upper mounting assembly being extending between said arm portions of said first end member, said second end portion of said upper mounting assembly extending between said arm portions of said second end member;

a pair of spaced apart elongate braces extending between said first end bar of said base and said first end portion of said upper mounting assembly, each of said braces having a hole therethrough; p1 elongate first and second upper bars for supporting the reservoir assembly, said first and second upper bars extending between said arm portions of said first end member, said first and second bars being spaced apart from each other and being interposed between said upper cross portion of said first end member and said first end portion of said upper mounting assembly;

a handle member having a pair of spaced apart elongate arms and a main portion, said handle member extending from said first end member away from said second end member, said handle member extending beyond the plane of said first end member and beyond the first ends of said side bars of said base for protecting the reservoir assembly when mounted on said first and second upper bars, said handle member being positioned between said upper bars, one of said arms of said handle member being coupled to one of said arm portions of said first end member, and another of said arms of said handle member being coupled to another of said arm portions of said first end member;

wherein said handle member lies in a plane substantially perpendicular to the plane said first end member lies in;

a pair of handle braces, each of said handle braces being generally triangular, one of said handle braces being coupled to one of said arm of said handle member and its associated arm portion of said first end member, another of said handle braces being coupled to another of said arms of said handle member and its associated arm portion of said first end member;

a pair of spaced apart elongate mounting brackets for supporting the electrical panel assembly, each of said mounting brackets having upper and lower ends, each of said mounting brackets having a hole, said upper end of each of said mounting brackets having a slot, each of said mounting brackets being coupled to said second end portion of upper mounting assembly and to said upper cross portion of said second end member, said upper ends of said of said mounting brackets being upwardly extended from said upper cross portion of said second end member such that said slots of said mounting brackets extend upwards from said upper cross portion of said second end member;

a bumper member being generally U-shaped and having a pair of spaced apart elongate arms and a main portion, said bumper member extending from said second end member away from said first end member, said bumper member extending beyond the plane of said second end member and beyond the second ends of said side bars of said base for protecting an electrical panel assembly mounted on said mounting brackets and ends of said heating elements assembly on said base, said arms of said bumper member being coupled to said second end portion of said upper mounting assembly such that one of said arms of said bumper member is positioned adjacent one of said arm portions of said second end member and another of said arms of said bumper member is positioned adjacent another of said arm portions of said second end member;

wherein said handle member is mounted to said first end member at a first distance from said base, and said bumper member is mounted to said second end member at a second distance from said base, and wherein said first distance is approximately twice said second distance;

wherein said handle member extends a distance from said first end member substantially equal to a distance that said bumper member extends from said second end member;

an elongate upper support beam mounted to and extending between each of said upper cross portions of said first and second end members, the length of said upper support beam being substantially equal to the lengths of said side portions of said upper mounting assembly;

said upper support beam having a pair of apertures adapted for receiving a hook for lifting said support frame, one of said apertures being located adjacent said first end member, another of said apertures being located adjacent said second end member;

a pair of spaced apart holding members for supporting a length of flexible hose on said support frame, each holding member having a pair of spaced apart fingers and a connecting portion, said connecting portions of said holding member being coupled to said upper support beam such that said upper support beam is positioned between said fingers of each holding portion; and an elongate sheath member for supporting a portion of the cleaning gun assembly, said sheath member having an open end for receiving sheath member being coupled to one of said side bars of said base at a location adjacent to said second end member and to the adjacent side portion of said upper mounting assembly at a substantially central location between said first and second end members such that the sheath member is positioned at an acute angle with respect to said base, said open end of said sheath member being positioned adjacent said upper mounting assembly.

19. The support frame of claim 1 wherein said handle member extends in a first direction beyond the plane of said first end member and beyond the first ends of said side bars of said base for protecting a reservoir assembly mounted on said first and second upper bars, and said bumper member extending in a second direction beyond the plane of said second end member and beyond the second ends of said side bars of said base for protecting an electrical panel assembly mounted on said mounting brackets and ends of said heating elements assembly on said base, said first direction being opposite of said second direction.

20. A support frame for a cleaning device having a heating elements assembly, an electrical panel assembly, a motor and pump assembly, a reservoir assembly for detergent, and a cleaning gun assembly, said support frame comprising:

a base having a pair of spaced apart elongate side bars and spaced apart elongate first and second end bars, each of said side bars of said base having first and second ends, said end bars of said base extending between said side bars of said base, said first end bar being positioned adjacent said first ends of said side bars of said base, said second end bar being positioned adjacent said second ends of said side bars of said base;

said base having ground engaging members downwardly depending therefrom;

first and second end members, each of said end members having an elongate upper cross portion, said first and second end members each extending substantially the same distance from said base;

said first end member being positioned adjacent said first ends of said side bars of said base, said first end member being adapted for supporting the reservoir assembly;

said second end member being positioned adjacent said second ends of said side bars of said base, said second end member being adapted for supporting the electrical panel assembly an an upper mounting assembly for supporting a motor and pump assembly, said upper mounting assembly being adapted to be spaced apart from said base and being interposed between said base and said upper cross portions of said end members;

a handle member having a pair of spaced apart elongate arms and a main portion, said handle member extending from said first end member away from said second end member;

a bumper member having a pair of spaced apart elongate arms and a main portion, said bumper member extending from said second end member away from said first end member;

an elongate sheath member for supporting a portion of a cleaning gun assembly, said sheath member being coupled to one of said side bars of said base at a location adjacent to said second end member and to the adjacent side portion of said upper mounting assembly at a substantially central location between said first and second end members such that the sheath member is positioned at an acute angle with respect to said base; and an elongate upper support beam mounted to and extending between each of said upper cross portions of said first and second end members for supporting said first and second end members when the reservoir assembly is mounted on said first end member and the electrical panel assembly is mounted on said second end member.

* * * * *